United States Patent [19]

Bochinski et al.

[11] Patent Number: 4,566,533

[45] Date of Patent: Jan. 28, 1986

[54] APPARATUS FOR CLEANING HEAT EXCHANGER PIPES AND METHODS OF OPERATING AN APPARATUS OF THIS TYPE

[75] Inventors: Rolf Bochinski, Duisburg; Klaüs Eimer, Ratingen; Harald Littek, Essen; Johannes Nasse, Hattingen, all of Fed. Rep. of Germany

[73] Assignee: Taprogge Gesellschaft mbH, Düsseldorf, Fed. Rep. of Germany

[21] Appl. No.: 471,014

[22] Filed: Mar. 1, 1983

[30] Foreign Application Priority Data

Mar. 2, 1982 [DE] Fed. Rep. of Germany ..... 3207466

[51] Int. Cl.[4] ..... F28G 1/12

[52] U.S. Cl. ..... 165/95; 15/3.51; 15/104.06 A; 134/8; 137/547; 277/81 P; 277/152

[58] Field of Search ..... 165/95; 137/268, 547, 137/625.48; 251/134; 210/181, 432; 134/8, 10; 277/81 P, 152; 15/3.5, 3.51, 104.06 A

[56] References Cited

U.S. PATENT DOCUMENTS

| | | | |
|---|---|---|---|
| 2,004,669 | 6/1935 | Miller | 277/152 |
| 2,469,758 | 5/1949 | Alcock | 165/9 |
| 3,099,454 | 7/1963 | Walinski | 277/152 |
| 3,841,397 | 10/1974 | Eimer | 165/95 |
| 3,872,920 | 3/1975 | Honma et al. | 165/95 |
| 3,914,676 | 10/1975 | Madonian et al. | 251/134 |
| 4,304,295 | 12/1981 | Otake | 165/95 |
| 4,413,673 | 11/1983 | de Maigret | 15/3.51 |

FOREIGN PATENT DOCUMENTS

| | | | |
|---|---|---|---|
| 2298753 | 8/1976 | France | 251/134 |
| 39754 | 10/1980 | Japan | 165/95 |

*Primary Examiner*—William R. Cline
*Assistant Examiner*—Randolph A. Smith
*Attorney, Agent, or Firm*—Herbert L. Lerner; Laurence A. Greenberg

[57] ABSTRACT

In the operation of cleaning the pipes of heat exchangers by means of sponge rubber balls which are entrained by the cooling water, a cylindrical housing is connected upstream of the heat exchanger, in which housing several chambers are formed by several dividing walls rotating about a vertical axis, and the chambers are subdivided by a horizontal sieve plate into an upper group of chambers for receiving the balls and into a lower group of chambers. In this arrangement, two opposite cooling water supply and removal connections are each provided in the region of the lower group of chambers, and two similar cooling water connections are provided in the region of the upper group of chambers which are connected to the heat exchanger pipes. In order to also allow a discontinuous cleaning operation, while stopping the balls and without interrupting the flow of cooling water, the present invention provides that the interior of the housing (2) is subdivided by three dividing walls (4,5,6) which are arranged at 120° to one another, into three equal chambers (7, 8, 9), each cross-sectional surface of which is approximately the same size as the cross-sectional surface of one of the cooling water connections (11 . . . 14).

28 Claims, 20 Drawing Figures

FIG. 3
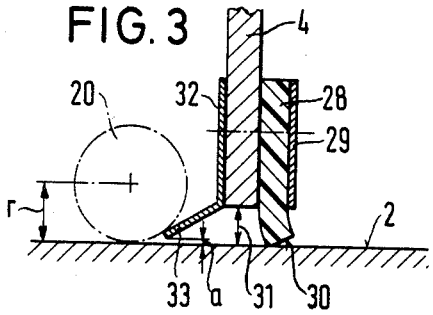
FIG. 4
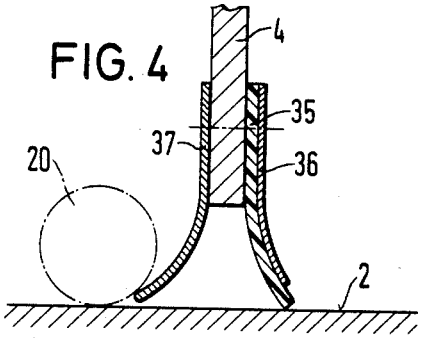
FIG. 5
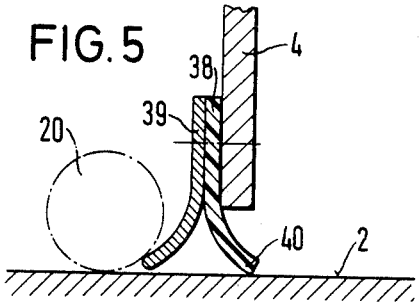
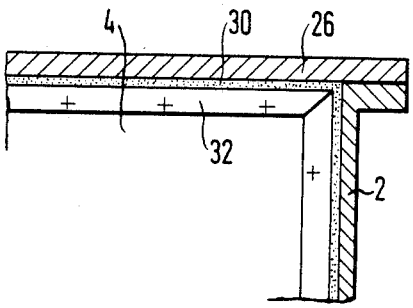
FIG. 6

APPARATUS FOR CLEANING HEAT EXCHANGER PIPES AND METHODS OF OPERATING AN APPARATUS OF THIS TYPE

This invention relates to an apparatus for cleaning heat exchanger pipes by means of elastic, spherical bodies, in particular sponge rubber balls. The apparatus comprises a cylindrical housing, in which chambers are formed by several dividing walls which rotate about a vertical axis, which chambers are subdivided by a horizontal sieve plate into an upper group of chambers for receiving the balls and into lower group of chambers, and comprises two opposite cooling water supply and removal connections in the region of the lower group of chambers, and two similar cooling water connections in the region of the upper group of chambers which are connected to the heat exchanger pipes.

In the case of large heat exchanger plant, for example condensers of steam generating stations, it is known to continuously clean the cooling water pipes by the conveyance through these pipes, in circulation with the cooling water, of cleaning bodies in the form of sponge rubber balls, the diameter of which is slightly larger than that of the cooling water pipes. This measure effectively prevents deposits in the pipes.

However, a cleaning operation of this type is also very appropriate in the case of smaller heat exchangers, for example in the case of air conditioning plant or for the heating water in heat pumps, in which relatively dirty untreated water in the form of river water, salt water or ground water is used. Consequently, a continuous operation may then be ensured, without the heat exchangers having to be stopped from time to time and having to be cleaned, for the most part manually. In unfavourable cases, the exchangers even have to be dismantled.

Japanese Pat. No. 1,049,909 discloses an apparatus for sea water desalination plant, of the type initially described. In this arrangement, six equal chambers are formed inside the housing by six dividing walls. The lower group of chambers separated by a sieve plate is used for supplying and removing the cooling water to and from the cleaning system and for the separation and discharge of impurities from the cooling water, while the cleaning balls are supplied with the cooling water to the heat exchanger pipes from the upper system of chambers and are re-collected from the pipes.

However, only a continuous circulation of the balls is possible with this apparatus. On the other hand, if a cleaning operation is only to be carried out discontinuously within certain time intervals, then in the known apparatus, while the dividing walls are at a standstill, at least a considerable number of the balls would constantly lie in the water flow and, with time, would be permanently deformed or eroded. It is impossible to simultaneously collect all the balls in one or more chambers which may be rotated out of the water flow into a closed position which is not charged by flowing water. However, this is absolutely necessary when the balls are to be removed from the device and are to be exchanged for new balls, without the complete water flow having to be shut off. Moreover, the danger exists in the known apparatus that during operation with a reduced throughput, the balls are not discharged sufficiently, or they are not discharged at all with the flow of cooling water, due to the considerable decrease in the flow velocity inside the housing. Finally, a very expensive sealing system comprising sealing water under elevated pressure is provided to seal off the individual chambers from each other. On the one hand, a very large quantity of sealing water is required even where there are very narrow sealing gaps, which quantity of water can make up a considerable amount of the actual cooling water, and on the other hand, sealing water which is free of impurities is only rarely available in these quantities.

In contrast thereto, an object of the present invention is to provide an apparatus with which a discontinuous operation is also possible during a standstill of the balls in a chamber which is not charged by the flow, and thus an exchange of the balls is also possible without shutting off the flow of cooling water. Furthermore, a reliable ball transport is to be ensured, and a cleaning of the supplied cooling water, separate from the ball circulation, and a discharge of the impurities is also to be ensured even when there is a reduced or a greatly fluctuating throughput. Moreover, a simple and operation-reliable sealing system without sealing water is to be provided.

To achieve this object, it is provided according to the present invention, proceeding from an apparatus of the initially mentioned type, that the interior of the housing is subdivided by three dividing walls, arranged at 120° to one another, into three equal chambers, each cross-sectional surface of which is approximately the same size as the cross-sectional surface of one cooling water connection.

In this arrangement, it is appropriate for the diameter of one cooling water connection to correspond at most to the length of a chord on the circumference of the housing having a central angle of 60°.

A design and arrangement of this type ensures that the cooling water supply and discharge are reliably separated from each other in any position of the dividing walls, that the flow velocity inside the housing does not substantially fall with respect to the flow velocity in the supply and removal lines and that there is always one chamber which is not connected to the supply or discharge of the water, so that the balls may be collected therein during idle phases.

In a further development of the present invention, for an additional seal of the chambers from each other, it is provided that the dividing walls are fitted with an encircling mechanical seal in the region of the walls of the housing and in the region of the top and bottom of the housing. This seal may comprise an elastic band which, seen in the direction of rotation, is attached to the respective rear side of the dividing walls, and the free end of which rests against the wall of the housing and is deflected oppositely to the direction of rotation. However, this seal may also be attached to the respective front side of the dividing walls and may project with its free end into the gap between the edge of the dividing wall and the inside wall of the housing, being deflected oppositely to the direction of rotation, and may rest against the housing wall.

The seal itself may be made of an elastic plastics material or an elastomer, or it may be made of an elastic steel strip which has a sliding layer on the sealing edge.

To prevent balls which are located in the wall region of the housing from being drawn into the sealing gap and being compressed due to their elasticity and conveyed into the following chamber, it is also appropriate for a guard fender which is made of a rigid material, is inclined in the direction of rotation and substantially covers the sealing gap to be positioned on the respective front side of the dividing walls, seen in the direction of rotation. The spacing between the fender outer edge and the inside wall of the housing should be at the most one third of the respective radius of the balls.

For an additional screening of the sealing regions in which most of the balls are located and also for screening the outer edge of the sieve plate, it is also appropriate for an encircling ring to be positioned at a small spacing to the housing inside walls at the height of this sieve plate which runs substantially transversely to the dividing walls. The ring should have a maximum height of the housing walls between the upper and the lower cooling water connections so that it does not reduce the flow cross section.

In addition to the known, flat design of the sieve plate, it is particularly advantageous to design the sieve plate to be approximately conical and to position it with the apex at the top. Consequently, impurities in the cooling water are kept away more easily from the housing walls. However, it is also possible for the sieve plate to comprise three individual, flat partial sieves which are positioned in the individual chambers in the shape of a pyramid running obliquely upwards.

In all embodiments of the sieve plate, the encircling ring should be attached to the outer edge of the plate.

In order to collect all the balls in one chamber outside the flow and, to this end, to determine the position of the dividing walls, a proximity switch is appropriately provided which is in operative connection with one dividing wall in a position thereof in which one of the chambers is shut off from the in-flowing and from the out-flowing cooling water.

For a further control of the dividing wall positions, a second proximity switch may be positioned being displaced by 60° to the first proximity switch.

With an arrangement of this type, a method of discontinuously operating the apparatus is possible according to the present invention, in which method, by rotating the dividing walls in steps of in each case 120°, an idle position follows an operating position in each case such that the balls are discharged from the chamber which is connected to the upper cooling water outlet connection and, after pasing through the heat exchanger pipes, are collected in the opposite chamber connected to the upper cooling water inlet connection and, after rotating by a further 120°, are held in an idle position in a chamber which is not connected to any of the cooling water connections.

Another method according to the present invention of continuously operating an apparatus of this type is characterised by a continuous rotation of the dividing walls, catching the balls by stopping the rotation in the position of one dividing wall at the first proximity switch and stopping in an idle position by triggering the second proximity switch.

It is also essential in a cleaning apparatus of this type that the balls may even be exchanged during the maintenance of the cooling water flow. According to the present invention, a pressure difference is produced for this purpose in the idle chamber containing the balls for rinsing out the balls. To this end, cooling water of a comparatively high pressure is introduced into the idle chamber and the balls are rinsed out with the cooling water to an area of a lower pressure.

An arrangement is appropriate for this rinsing out process, in which the upper cooling water outlet connection and the rest chamber are interconnected via a bypass line which may be shut off, and the idle chamber and the upper cooling water inlet connection are interconnected via another discharge line containing a sluice for the balls which may be shut off on both sides. The bypass line should discharge at the lowest point of the idle chamber, whereas the discharge line should discharge at an upper point of the idle chamber.

The ball sluice may appropriately have a collecting chamber for the balls to be removed and a charging chamber for balls to be used, both chambers being interconnected in terms of flow by a sieve-like division.

The design and operation of embodiments according to the present invention will now be described in more detail with reference to schematic drawings.

FIG. 3 shows a dividing wall having a seal and a fender corresponding to the sectional line III—III in FIG. 1;

FIG. 4 shows another embodiment of a seal and a fender in cross section;

FIG. 5 shows another design of a seal and a fender;

FIG. 6 is an enlarged view of a corner of a dividing wall;

Figure 7A:
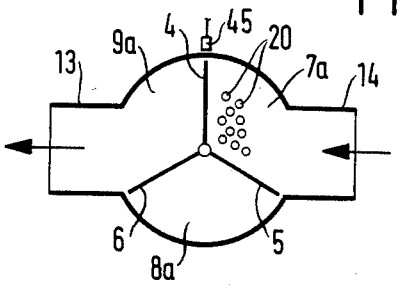
Figure 7B:
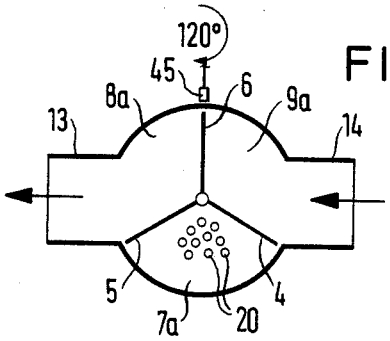
Figure 7C:
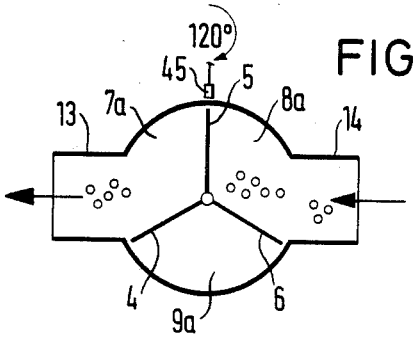
Figure 8A:
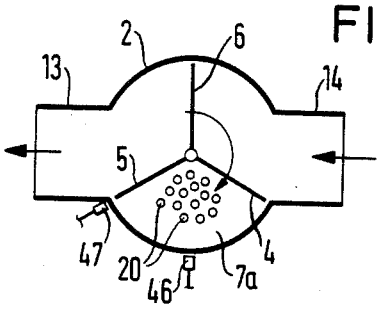
Figure 8B:
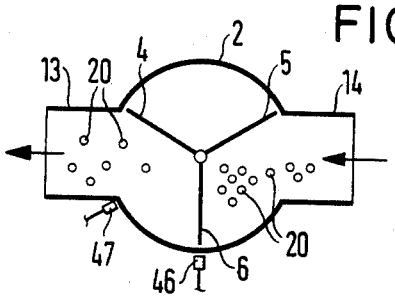
Figure 8C:
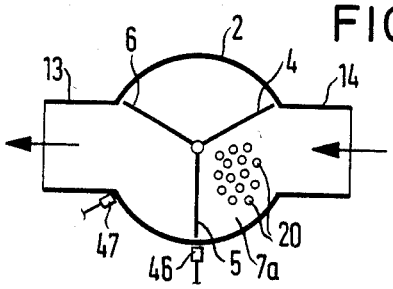
Figure 8D:
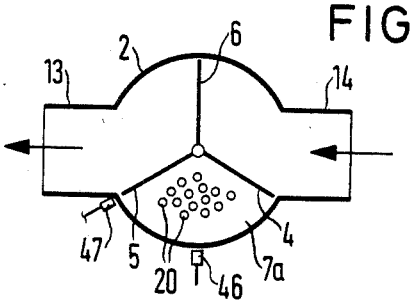
Figure 9A:
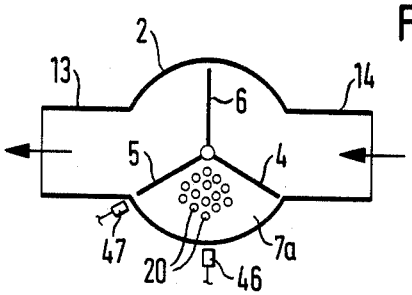
Figure 9B:
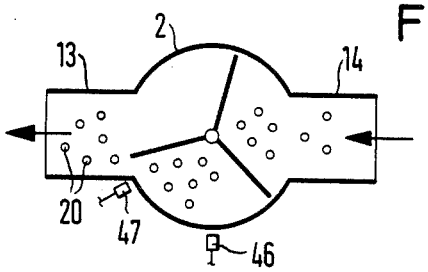
Figure 9C:
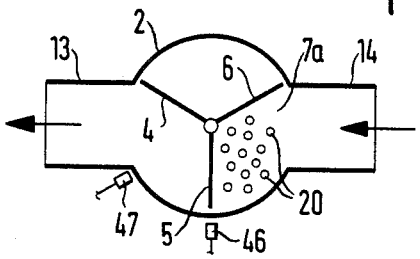
Figure 9D:
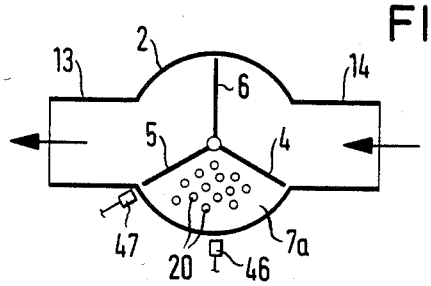
Figure 10A:
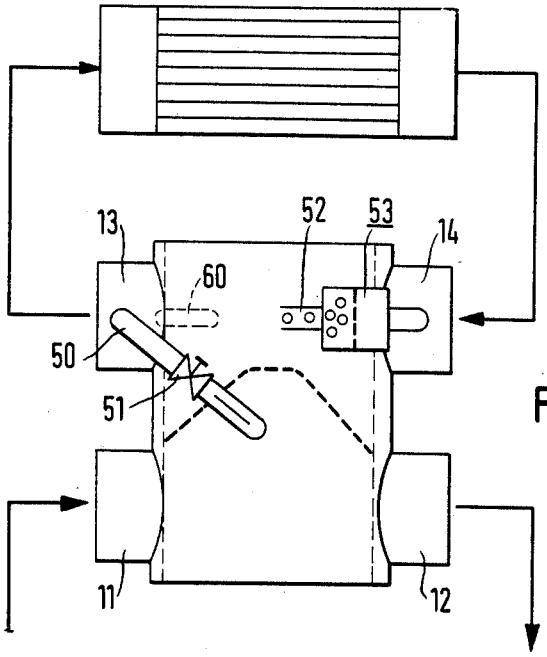
Figure 10B:
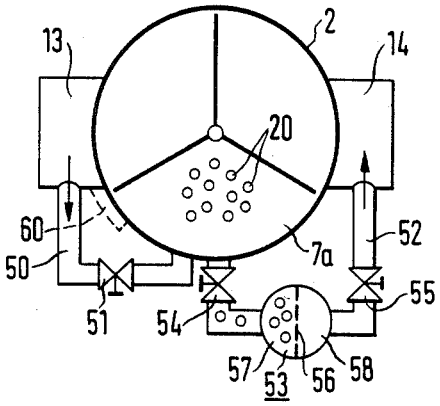
Figure 11:
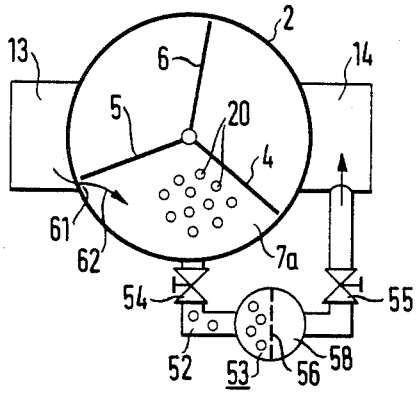

FIGS. 7A–C show the operating method of the apparatus comprising only one proximity switch;

FIGS. 8A–D show the discontinuous operating method of the apparatus comprising two proximity switches;

FIGS. 9A–D show the continuous operating method;

FIGS. 10A and B show an arrangement for exchanging the ball, in a side view and in a top view, and FIG. 11 shows a position of the dividing wall for the ball discharge.

Figure 1:
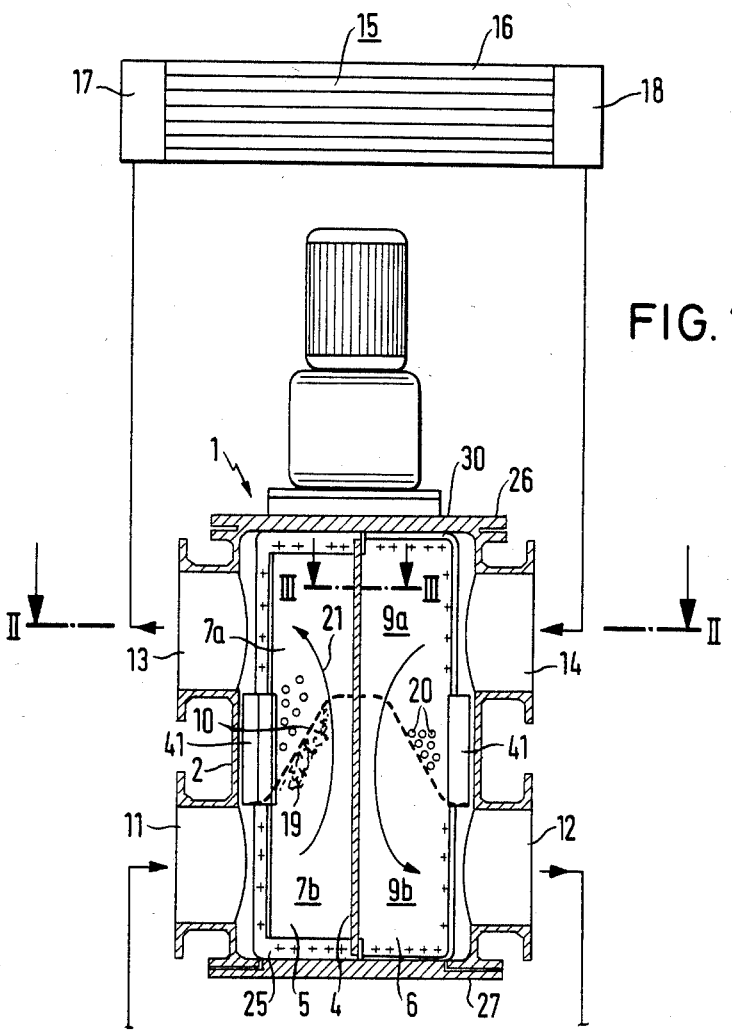
FIG. 1 shows a complete arrangement of the cleaning plant, including a longitudinal section through the apparatus.
Figure 2:
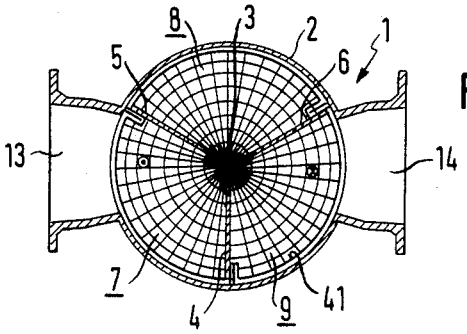
FIG. 2 shows a cross section through the apparatus corresponding to the sectional line II—II in FIG. 1.

As may be seen from FIGS. 1 and 2, the cleaning apparatus 1 comprises a cylindrical housing 2, inside which three radial dividing walls 4, 5 and 6 are positioned which rotate about a longitudinal axis 3 and are displaced with respect to each other by 120° in each case. Consequently, three separate chambers 7, 8 and 9 are formed. A generally conical sieve plate 10 is positioned with its apex at the top approximately half way up the housing 2, transversely to the dividing walls 4, 5 and 6. This sieve plate 10 subdivides the chambers formed by the dividing walls into an upper group of chambers 7*a*, 8*a* and 9*a* and into a lower group of chambers 7*b*, 8*b* and 9*b*.

At the level of the lower group of chambers 7*b*, 8*b* and 9*b*, the housing 2 has a cooling water supply connection 11 and a cooling water removal connection 12 which are opposite each other, while a cooling water removal connection 13 and a cooling water return connection 14 which are also opposite each other are provided in the region of the upper group of chambers 7*a*, 8*a* and 9*a*.

The cooling water for the schematically indicated heat exchanger 15 flows from a cooling water source which is not shown in more detail into the lower chamber 7*b* and from there, flows via the sieve plate 10 into the upper chamber 7*a*, impurities 19 being held back on the lower side of the sieve plate 10. In the upper chamber 7*a*, the cooling water entrains the cleaning balls 20 and flows from there via the cooling water removal connection 13 into the inlet chamber 17 of the heat exchanger 15. While flowing through the pipes 16, deposits which may be present are entrained by the elastic balls 20 or a deposit on the inside walls of the pipes is generally avoided. Thereafter, the cooling water leaves the heat exchanger 15 via the outlet chamber 18 and flows via the cooling water return connection 14 into the upper chamber 9*a*. In this chamber, the balls 20 are held back by the sieve plate 10 during the downwards flow of the cooling water into the lower chamber 9*b*. As a result of the rotation of the dividing walls 5, 6 and 7 together with the sieve plate 10, for example in a clockwise direction, the balls 20 return into the cold cooling water flow 21 and from there, again pass into the heat exchanger 15, while cooling water impurities 19 below the sieve 10 are rotated into the chamber 9*b* and are discharged from this chamber with the heated cooling water which runs away via the cooling water removal connection 12.

As may be seen from FIGS. 1 and 2, the cooling water connections 11 to 14 and the chambers 7, 8 and 9 each have approximately the same free cross section for the throughflowing cooling water. This measure ensures that the flow velocity in the supply and discharge lines and in the chambers themselves does not substantially differ, but is approximately constant. This ensures that even when there is a low load on the heat exchanger and when there is a lower cooling water throughput stipulated thereby and thus also a slower flow velocity, the cleaning bodies are always reliably entrained by the cooling water and are not left lying in the upper chamber 7*a* on account of too small a flow.

This result may generally also be achieved in that the diameter of one cooling water supply connection, for example 11 corresponds at the most to a central angle of 60° on the circumference of the housing or on a corresponding chord. Thus, it is ensured that in a suitable position of the dividing walls, as may be seen, for example from FIG. 2, there is always one chamber which does not have a throughflow of cooling water and which is not connected to the cooling water discharge or to the cooling water supply.

For sealing off the individual chambers from each other and to ensure a reliable seal of the in-flowing cooling water against the out-flowing cooling water, the dividing walls have additional seals 25 for the inside walls of the housing, for the top 26 of the housing and for the bottom 27 of the housing. Various embodiments of the seals are illustrated in FIGS. 3 to 6.

According to FIG. 3, an elastic sealing band 28 made, for example of a flexible plastic material or rubber or another elastomer is attached to the rear side of the dividing wall 4 by a holding plate 29 by means of a screw connection or a similar securing method. The free end 30 of this seal 28 is deflected oppositely to the direction of rotation of the dividing wall and it rests slidingly against the inside wall of the housing 2.

This seal may also comprise a flexible steel plate which is not shown, the sealing edge of which has a sliding layer, for example in the form of PTFE.

As may be seen from the Figure, the dividing wall has to terminate at a certain spacing from the inside wall of the housing for production reasons. Consequently, there is the danger that the relatively flexible cleaning bodies of sponge rubber will be drawn into the gap 31 and will pass into the next chamber. To prevent this, a guard fender 32 which is made of a rigid material and substantially covers the sealing gap 31 is positioned on the front side of the dividing wall, seen in the direction of rotation, and the outwardly lying end 33 of the fender 32 is inclined in the direction of rotation in the region of the sealing gap 31. As illustrated in the Figure, this measure effectively prevents balls 20 from being drawn into the gap 31. The remaining outer spacing a of the fender 32 appropriately amounts at the most to one third of the respective radius r of the balls 20.

Another embodiment for bridging the gap is illustrated in FIG. 4. In this Figure, the seal 35 is longer and thinner, the holding device 36 also being guided almost up to the end of the sealing strip 35 to ensure the necessary stability. The opposite fender 37 is continuously curved at its front end to allow a gentle catching and deflection of the balls.

According to the embodiment illustrated in FIG. 5, the sealing band 38 and the fender 39 are positioned on the same side of the dividing wall, and that is on the front side, seen in the direction of rotation, the fender 39 simultaneously being used as a holding device for the sealing band 38. The free end 40 of the sealing band 38 is again deflected oppositely to the direction of rotation, and it projects into the gap between the edge of the dividing wall and the inside wall of the housing.

Finally, it may be seen from FIG. 6 that the fender 32 and the sealing edge 30 are guided around the corners of the dividing walls 4 at a right angle and with a sharp edge to ensure an effective seal in this region as well.

However, in order to most effectively prevent the balls 20 from becoming wedged in the region in which most of the balls are located, namely directly above the sieve body 10, an encircling ring 41 is positioned at the level of this sieve plate 10 as an additional safety device, as may be seen from FIGS. 1 and 2. This ring 41 is appropriately attached to the outer edge of the sieve plate 10 at a small spacing from the inside wall of the housing and it has a maximum height of the housing wall between the lower and the upper cooling water connections 11 and 12 as well as and 13 and 14 respectively, to prevent the free flow cross section from being restricted in the region of the connections. Thus, the cleaning balls 20 are substantially held inside the region of this ring 41 and thus practically never come into contact with the wall of the housing, but are generally discharged directly above the ring 41 via the connection 13.

Various operating methods and types of arrangement of the cleaning apparatus according to the present invention will now be described in the following with reference to FIGS. 7 to 9. It is an essential feature that in each case after a cleaning phase which may vary in duration, depending on requirements, the cleaning balls inside the apparatus may be brought into an idle position, without the circulation and the effect of the cooling water being interrupted or hindered. It is also possible, as will be described further on in the text, to exchange the balls in this idle phase without disturbing the over-all operation.

FIGS. 7A–C illustrate a section through the upper group of chambers generally corresponding to the sectional line II—II according to FIG. 1. The dividing walls 4, 5 and 6 have occupied a position such that an effective separation of the out-flowing cooling water via the connection 13 from the in-flowing cooling water via the cnnection 14 is ensured. Moreover, one chamber, in this case 8*a* is completely shut off from the flow of cooling water. In order to be able to indicate the position of the dividing walls and also to be able to stop them in this or in an equivalent position, a proximity switch 45 is positioned at one point, just occupied by the dividing walls, being displaced by 90° to the axis of the connection 13 according to the Figure. This switch 45 emits a signal, for example to a counter, by which the rotation may then also be stopped in the desired position.

According to FIG. 7A, the balls have first of all been rinsed out with the cooling water from the chamber 9*a* and are just being caught and collected in the chamber 7*a* downstream of the connection 14 with the returning cooling water. After a predetermined time, the dividing walls are started to rotate until the next dividing wall 6 reaches the proximity switch 45 and is stopped at this point. After this 120° step, the chamber 7*a* with the balls 20 has reached the position according to FIG. 7B, by which the balls 20 are moved out of the flowing cooling water into the idle position, while the actual cooling of the heat exchanger may continue unhindered.

When another cleaning cycle is required, the dividing walls take another 120° step, as a result of which a position according to FIG. 7C is occupied. The chamber 7*a* is now in connection with the cooling water outlet connection 13, so that the balls 20 are caught by the cooling water which is flowing in from below and are discharged into the heat exchanger to be cleaned. Thereafter, they are again caught via the connection 14 in the now opposite chamber 8*a* and may then be redelivered from here to the idle position.

Since in this arrangement, idle and operating positions follow each other in each case, it is possible using only one step counter to establish in which chamber or in which position the balls are just then located, i.e., for example.

Counter 1,2,1,2,1,2,1,2,1 (with "1" as the idle position)

or: 1,2,3,4,5,6,7 (idle position: odd numbers).

If, however, a disturbance occurs, for example a power failure, the contents of the counter may be lost, so that it is no longer known in which position the balls are just then located.

This disadvantage may be overcome by the provision of another proximity switch which is at a position displaced by 60° from the first proximity switch. In this respect, according to FIGS. 8A–D, for example a switch 46 is positioned at an angle of 270° to the axis of the outlet connection 13, and another proximity switch 47 is positioned at an angle of 330°. Proceeding from the idle position according to FIG. 8A in which the balls 20 are held in the chamber 7*a* while the proximity switch 47 is triggered, the balls are released into circulation after the rotation of the dividing walls into a position according to FIG. 8B. Thereafter, several 120° steps may be made for a comparatively long cleaning phase. In order to prepare the idle position, the dividing walls are stopped in a position according to FIG. 8C until all the balls have been re-caught. The lower dividing wall 5 then triggers the proxmity switch 47, so that the idle position according to FIG. 8A is again occupied.

FIGS. 9A–D illustrate a similar arrangement, but in this case, a continuous cleaning operation is possible over a longer period of time. Proceeding from the idle position according to FIG. 9A, the dividing walls are continuously rotated according to FIG. 9B, so that the balls are continuously conveyed from the right-hand collecting chamber into the left-hand outflow chamber. To catch the balls, the dividing walls are then stopped again in a position corresponding to FIG. 9C and are then moved into the idle position according to FIG. 9D.

The advantage of the arrangement according to FIGS. 8A–D and 9A–D is that the balls are always caught by any dividing wall by triggering the proximity switch 46, independently of a previous position or operating method, and these balls are moved into the idle position with the subsequent triggering of the proximity switch 47.

After a comparatively long operation of the cleaning apparatus and a comparatively long use of the balls, it is necessary to remove the balls and to replace them by new balls. The balls are to be exchanged without the flow of cooling water being interrupted. In principle, it would be possible in this respect to position a flap in the region of the front idle chamber in the housing wall, for which purpose, however, the dividing walls 4, 5 and 6 would have to completely seal the chambers off, because otherwise water would issue from this chamber during the exchange of the balls.

Therefore, in a further development of the present invention, a more appropriate arrangement is provided, as is described with reference to FIGS. 10A and B. According thereto, the elevated pressure difference between the issuing and the returning cooling water is applied in principle to the idle chamber, as a result of which the balls are washed out into a ball sluice.

In particular, a bypass line 50 provided with a slide valve 51 is guided from the cooling water outlet connection 13 into the idle chamber 7*a*, where it discharges at as low a point as possible in the region of the foot of the sieve or thereunder. A discharge line 52 issues from a higher point of the idle chamber 7*a* and it discharges back into the system at a point of lower pressure, for example discharging into the cooling water return connection 14. The actual ball sluice 53 is positioned in this discharge line 52 and it may be shut off on both sides by slide valves 54 and 55. This ball sluice 53 is itself subdivided by a sieve-like dividing wall 56 into a collecting chamber 57 and a charging chamber 58.

When the balls have to be removed, the slide valves 51, 54 and 55 are opened. As a result of this action, water at a comparatively high pressure flows out of the outlet connection 13 into the idle chamber 7*a* and washes the balls 20 via the discharge line 52 into the collecting chamber 57 of the ball sluice 53. After the valves 51, 54 and 55 have been shut off, the balls may then be removed from the collecting chamber 57 and new balls may be introduced into the charging chamber 58. After all the valves have been opened, the balls are washed out into the return connection 14 and thus they return into the circulation.

However, instead of a separate bypass line 50 having a slide valve 51, it is also possible to provide a corresponding bypass directly in the housing wall 2, as indicated in dashed lines by the channel 60 in FIGS. 10A and B. For this purpose, the housing may have a groove-like bulge which, on its own, produces a bypass flow around the dividing wall 5 and makes it possible for high pressure water to pass out of the connection 13 into the rest chamber 7*a*.

FIG. 11 illustrates another possibility of producing a pressure difference in the rest chamber 7*a*. According thereto, the dividing walls are rotated by a small amount, at the most by about 10°, in the direction of rotation out of their idle position, so that a narrow gap 61 is provided at the dividing wall 5 to the cooling water outlet connection 13. As a result of this measure, water at a comparatively high pressure may flow into the rest chamber 7*a* in the direction of arrow 62 and may thus cause a discharge of the balls 20 into the discharge line 52. This further rotation of the dividing walls may be carried out manually or automatically by means of another proximity switch.

With the apparatus which has been described and with the specified operating methods, a cleaning plant is provided using the operating methods which, in heat exchange circulations, cleans not only the cooling medium, which does not only have to be water, but also the heat exchanger may be cleaned and impurities which are present may also be removed from the cooling medium, independently of the heat exchanger cleaning operation.

With the three-chamber principle according to the present invention, the lowest possible number of chambers is provided which ensures a permanent seal of the in-flowing medium against the out-flowing medium. Consequently, the apparatus has the smallest possible dimensions, because $2\times\frac{1}{3}$ of the complete cross-sectional surface is always penetrated by the medium, so that an adequate speed in the chambers is also constantly provided in order to reliably discharge the balls and to transport them through the heat exchanger. A dividing wall position is simultaneously provided having one idle chamber, through which the medium does not flow and in which all the balls may be collected and caught in the idle phase, without the cooling of the heat exchanger being interrupted thereby. Consequently, the balls are not continuously exposed to the flow of cooling water, which means that their life expectancy and their complete usability is extended. The balls may then be rinsed out of this idle chamber, again without an interruption in the cooling water circulation, and they may be removed and exchanged for new balls.

The embodiments which have been illustrated show only a few design possibilities of the inventive basic principle. Thus, for example, it is also possible for the apparatus to be operated in a horizontal arrangement, without any changes being made to the operating method.

What is claimed is:

1. An apparatus for cleaning heat exchanger pipes by means of elastic, spherical balls, comprising a vertical cylindrical housing, three rotatable dividing walls radially-extending from a vertical axis and defining three chambers each occupying substantially 120° in said housing, said dividing walls separating said housing into three chambers of substantially equal size each having a given cross-sectional area, a sieve plate disposed substantially horizontally across said dividing walls, said sieve plate dividing said chambers into an upper group of sub-chambers for receiving the balls and a lower group of sub-chambers, a lower cooling water supply connection and a lower cooling water removal connection in communication with said lower group of sub-chambers at opposite locations on said housing, an upper cooling water supply connection and an upper cooling water removal connection being in communication with said upper group of sub-chambers at opposite locations on said housing, and means for communicating said upper connections to the heat exchanger pipes, all of said connections each having substantially said given cross-sectional area, and said connections each having a diameter being less than the length of a chord of the circumference of said housing described by a central angle of at most 60°, whereby one of said sub-chambers of said upper group may be positioned as an idle chamber wherein the balls therein are out of communication with the heat exchanger pipes.

2. An apparatus according to claim 1, characterized in that the diameter of one cooling water connection (11 . . . 14) corresponds at most to the length of a chord on the circumference of the housing having a central angle of 60°.

3. An apparatus according to claim 1, characterised in that the housing includes walls, a top and a bottom, and the dividing walls (4, 5, 6) are provided with an encircling mechanical seal (28; 35; 38) in the region of the walls of the housing (2) and in the region of the top (26) of the housing and the bottom (27) of the housing.

4. An apparatus according to claim 3, characterised in that the dividing walls have a trailing side as seen in the direction of rotation, and the seal comprises an elastic band (28; 35) with a free end, the elastic band is attached to the trailing side of the dividing walls (4, 5, 6), and the free end (30) of the elastic band rests against the housing wall (2) and is deflected oppositely to the direction of rotation.

5. An apparatus according to claim 3, characterised in that the seal comprises an elastic band (38) which is attached to the respective front side of the dividing walls (4, 5, 6) in the direction of rotation, and the free end (40) of which projects into the gap (31) between the edge of the dividing wall (4), and the housing wall (2), being deflected oppositely to the direction of rotation, and rests against the housing wall (2).

6. An apparatus according to claim 3, characterised in that the seal (28; 35; 38) is made of an elastic plastic material.

7. An apparatus according to claim 1, characterised in that the dividing walls are spaced from the housing defining a sealing gap therebetween, and the dividing walls have a leading side as seen in the direction of rotation, and including a guard fender (32; 37; 39) which is made of a rigid material, is inclined in the direction of rotation, substantially covers the sealing gap (31) and is positioned for the balls (20) on the respective leading side of the dividing walls (4, 5, 6).

8. An apparatus according to claim 7, characterised in that the balls have a given radius, the housing has an inside wall, and the guard fender has an outer edge spaced from the inside wall of the housing by a given spacing, the spacing (a) between the outer edge (33) of the guard fender and the inside wall of the housing (2) being at most one third of the given radius (r) of the balls (20).

9. An apparatus according to claim 3, characterised in that the dividing walls have outer-lying corners and the dividing walls are spaced from the housing defining a sealing gap therebetween, and including a guard fender substantially covering the sealing gap, the seal (30) and the guard fender (32) being guided with a sharp edge around the outer-lying corners of the dividing walls (4, 5, 6).

10. An apparatus according to claim 1,
characterised in that an encircling ring (41) is positioned at a small spacing to the inside wall of the housing at the level of the sieve plate (10) said encircling ring running transversely to the dividing walls (4, 5, 6).

11. An apparatus according to claim 10, characterised in that the ring (41) has a maximum height of the housing wall between the lower and the upper cooling water connections (11,12; 13,14).

12. An apparatus according to claim 1,
characterised in that the sieve plate (10) is designed to be approximately conical.

13. An apparatus according to claim 12, characterised in that the conical sieve plate (10) is positioned with its apex at the top.

14. An apparatus according to claim 10, characterised in that the encircling ring (41) is attached to the outer edge of the sieve plate (10).

15. An apparatus according to claim 1, characterised in that in-flowing cooling water and out-flowing cooling water flows through said upper sub-chambers and the heat exchanger pipes, and a proximity switch (45; 47) is provided which is in operative connection with one dividing wall in a position thereof in which one of the chambers (7a, 8a, 9a) is shut off from the in-flowing cooling water and from the out-flowing cooling water.

16. An apparatus according to claim 15, characterised in that a second proximity switch (46) for detecting the approach of a dividing wall is positioned in a displacement of 60° to the first proximity switch (47).

17. An apparatus according to claim 1, wherein said dividing walls have circular outer edges, and said upper sub-chambers include an upper idle sub-chamber for idle balls, and including circular mechanical seals disposed on said circular outer edges, and a radially-directed discharge line connected to said housing at said idle sub-chamber for removing balls.

18. An apparatus according to claim 3, wherein the seal is made of an elastomer.

19. An apparatus according to claim 1, wherein one of said upper sub-chambers is an idle chamber for idle balls, and including a closeable bypass interconnecting said upper cooling water removal connection and said idle chamber, a discharge line interconnecting said idle chamber and said upper cooling water supply connection, a sluice disposed in said discharge line, and means for closing off two sides of said sluice.

20. Apparatus according to claim 19, wherein said bypass is in the form of a gap of not more than 10° between one of said dividing walls and said upper cooling water removal connection formed by rotating said one dividing wall toward said upper cooling water removal connection for creating a partial flow at an elevated pressure into said idle chamber.

21. An apparatus according to claim 19, wherein the ball sluice (53) has a collecting chamber (57) for balls (20) to be removed, and has a charging chamber (58) for balls (20) to be used, the chambers (57, 58) being separated from each other by a sieve-like dividing wall (56).

22. An apparatus according to claim 19, wherein the bypass line is formed by in inwardly open groove (60) which is made in the wall of the housing (2).

23. Method of cleaning heat exchanger pipes by means of sponge rubber balls in an apparatus including a cylindrical housing, three radially-directed dividing walls rotatable about a vertical axis and mutually offset by substantially 120° in the housing, the dividing walls separating the housing into three chambers of substantially equal size each having a given cross-sectional area, a sieve plate disposed substantially horizontally across the dividing walls, the sieve plate dividing the chambers into an upper group of sub-chambers for receiving the balls and a lower group of sub-chambers, a lower cooling water supply connection and a lower cooling water removal connection in communication with the lower group of sub-chambers at opposite locations on the housing, an upper cooling water supply connection and an upper cooling water removal connection being in communication with the upper group of sub-chambers and being connected to the heat exchanger pipes, the connections each having substantially the given cross-sectional area, the dividing walls being rotatable stepwise through 120° at a time alternately into sequential idle and operating positions in which one of the chambers is in communication with the upper cooling water removal connection and another of the chambers is in communication with the upper cooling water supply connection, which comprises discharging the balls from the one chamber, passing the balls through the heat exchanger pipes, collecting the balls in the other chamber, rotating the dividing walls through 120°, and holding the balls in a chamber no longer in communication with any of the connections.

24. Method of cleaning heat exchanger pipes by means of sponge rubber balls in an apparatus including a cylindrical housing, three rotatable dividing walls radially-extending from a vertical axis and defining three chambers each occupying substantially 120° in the housing, the dividing walls separating the housing into three chambers of substantially equal size each having a given cross-sectional area, a sieve plate disposed substantially horizontally across the dividing walls, the sieve plate dividing the chambers into an upper group of sub-chambers for receiving the balls and a lower group of sub-chambers, a lower cooling water supply connection and a lower cooling water removal connection in communication with the lower group of sub-chambers at opposite locations on the housing, an upper cooling water supply connection and an upper cooling water removal connection being in communication with the upper group of sub-chambers at opposite locations on the housing, and means for communicating the upper connections to the heat exchanger pipes, all of the connections each having substantially the given cross-sectional area, and the connections each having a diameter being less than the length of a chord of the circumference of the housing described by a central angle of at most 60°, the dividing walls being rotatable through 120° at a time, a first proximity switch operatively connected to one of the dividing walls in a position in which one of the chambers is shut off from the connections, and a second proximity switch displaced 60° relative to the first proximity switch for detecting the approach of a dividing wall, which comprises switching the dividing walls into rotation through 120° at a time with the second proximity switch to circulate the balls, stopping the rotation to catch the balls in a chamber in communication with the upper cooling water supply connection, and stopping the rotation of the dividing walls in an idle position in which the balls are in one of the sub-chambers of the upper group which is out of communication with the heat exchanger pipes by triggering the first proximity swtich.

25. Method of cleaning heat exchanger pipes by means of sponge rubber balls in an apparatus including a cylindrical housing, three rotatable dividing walls radially-extending from a vertical axis and defining three chambers each occupying substantially 120° in the housing, the dividing walls separating the housing into three chambers of substantially equal size each having a given cross-sectional area, a sieve plate disposed substantially horizontally across the dividing walls, the sieve plate dividing the chambers into an upper group of sub-chambers for receiving the balls and a lower group of sub-chambers, a lower cooling water supply connection and a lower cooling water removal connection in communication with the lower group of sub-chambers at opposite locations on the housing, an upper cooling water supply connection and an upper cooling water removal connection being in communication with the upper group of sub-chambers at opposite locations on the housing, and means for communicating the upper connections to the heat exchanger pipes, all of the connections each having substantially the given cross-sectional area, and the connections each having a diameter being less than the length of a chord of the circumference of the housing described by a central angle of at most 60°, a first proximity switch operatively connected to one of the dividing walls in a position in which one of the chambers is shut off from the connections, and a second proximity switch displaced 60° relative to the first proximity switch for detecting the approach of a dividing wall, which comprises continuously rotating the dividing walls, catching the balls by stopping the rotation of the dividing walls with one of the dividing walls at the second proximity switch, and stopping the rotation of the dividing walls in an idle position in which the balls are in one of the sub-chambers of the upper group which is out of communication with the heat exchanger pipes by triggering the first proximity switch.

26. Method of cleaning heat exchanger pipes by means of sponge rubber balls in an apparatus including a cylindrical housing, three rotatable dividing walls radially-extending from a vertical axis and defining three chambers each occupying substantially 120° in the housing, the dividing walls separating the housing into three chambers of substantially equal size each having a given cross-sectional area, a sieve plate disposed substantially horizontally across the dividing walls, the sieve plate dividing the chambers into an upper group of sub-chambers for receiving the balls and a lower group of sub-chambers, a lower cooling water supply connection and a lower cooling water removal connection in communication with the lower group of sub-chambers at opposite locations on the housing, an upper cooling water supply connection and an upper cooling water removal connection being in communication with the upper group of sub-chambers at opposite locations on the housing, and means for communicating the upper connections to the heat exchanger pipes, all of the connections each having substantially the given cross-sectional area, and the connections each having a diameter being less than the length of a chord of the circumference of the housing described by a central angle of at most 60°, one of the upper sub-chambers may be positioned as an idle chamber of the upper group of sub-chambers which is out of communication with the heat exchanger pipes for idle balls, which comprises producing a pressure difference in the idle chamber for rinsing out the balls therein.

27. A method according to claim 26, characterised in that cooling water under a comparatively high pressure in introduced into the idle chamber, and the balls are rinsed out with the cooling water to a point under a comparatively low pressure.

28. A method according to claim 27, characterised in that the dividing wall (5) shutting off the idle chamber (*7a*) from the cooling water outlet connection (13) is rotated into the opening angle of the cooling water outlet connection (13) by a gap width of not more than 10° such that a partial flow of the issuing cooling water under a comparatively high pressure passes over into the idle chamber (*7a*).

* * * * *